US008061156B2

(12) United States Patent
Hayase

(10) Patent No.: US 8,061,156 B2
(45) Date of Patent: Nov. 22, 2011

(54) COOLING DEVICE WITH A FAN CASING HAVING A DRAIN PATH

(75) Inventor: Koji Hayase, Ota (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 753 days.

(21) Appl. No.: 12/010,676

(22) Filed: Jan. 29, 2008

(65) Prior Publication Data

US 2008/0190128 A1 Aug. 14, 2008

(30) Foreign Application Priority Data

Feb. 8, 2007 (JP) ..... 2007-029687

(51) Int. Cl.
*F25D 21/14* (2006.01)

(52) U.S. Cl. ..... 62/288

(58) Field of Classification Search ..... 62/150, 62/230, 249, 256, 259.1, 263, 280, 285, 288, 62/291, 302
See application file for complete search history.

(56) References Cited

U.S. PATENT DOCUMENTS

| | | | | |
|---|---|---|---|---|
| 2,794,624 | A | 6/1957 | Campagna et al. | 257/8 |
| 3,797,269 | A | 3/1974 | De Jarlais | 62/280 |
| 5,761,922 | A * | 6/1998 | Tamai et al. | 62/256 |
| 6,892,551 | B2 * | 5/2005 | Gunji et al. | 62/262 |
| 2003/0029184 | A1 * | 2/2003 | Ohama et al. | 62/262 |
| 2005/0217301 | A1 | 10/2005 | Iguchi et al. | 62/302 |

FOREIGN PATENT DOCUMENTS

| | | | |
|---|---|---|---|
| AU | 495 892 | B2 | 2/1978 |
| DE | 31 08 559 | A1 | 1/1982 |
| EP | 1 129 649 | A2 | 9/2001 |
| JP | 08-233436 | | 9/1996 |
| JP | 2000-258032 | | 9/2000 |
| JP | 2001-280210 | | 10/2001 |
| JP | 2004150658 | A * | 5/2004 |
| JP | 2005009779 | A * | 1/2005 |

OTHER PUBLICATIONS

European Search Report dated Jun. 23, 2008.
Japanese Office Action issued for counterpart Japanese Patent Application No. 2007-029687 dated Jul. 19, 2011, and English translation of Japanese Office Action.

* cited by examiner

*Primary Examiner* — Frantz Jules
*Assistant Examiner* — Emmanuel Duke
(74) *Attorney, Agent, or Firm* — Kratz, Quintos & Hanson, LLP

(57) ABSTRACT

There is disclosed a cooling device capable of simplifying attachment of a blower for a condenser and a structure of a drain path from an evaporator, and the cooling device includes a condenser constituting a part of a refrigerant circuit, a condenser blower which air-cools this condenser, and a fan casing attached to the condenser and provided with the condenser blower. The fan casing is integrally provided with a bracket part for attaching a motor of the condenser blower.

4 Claims, 5 Drawing Sheets

COOLING DEVICE WITH A FAN CASING HAVING A DRAIN PATH

BACKGROUND OF THE INVENTION

The present invention relates to a cooling device including a condenser of a refrigerant circuit and a condenser blower which air-cools the condenser.

Heretofore, for example, in a low temperature showcase, a display chamber is constituted in a main body, cold air cooled in an evaporator of a refrigerant circuit is circulated through the display chamber to cool the inside of the chamber, and a compressor, the condenser and the like are installed in a mechanical chamber constituted in a lower part of the main body. Then, a condenser blower for air-cooling the condenser is provided in a fan casing attached to the condenser.

In this case, the fan casing is heretofore attached to tube plates on opposite sides of the condenser, and the condenser blower is positioned in grilles formed in an opening of this fan casing. Then, it is constituted that a driving motor for rotating the condenser blower is attached to the fan casing via brackets (fixing members) (e.g., see Japanese Patent Application Laid-Open No. 2000-258032).

Thus, the motor of the condenser blower is heretofore attached to the fan casing with the brackets disposed separately from the fan casing, so that the number of components increase, and an assembly operation such as positioning with respect to the grilles becomes laborious. Moreover, the mechanical chamber is also provided with a drain pan for receiving and accumulating drain water (defrosting water or the like) from the evaporator to evaporate the water with air blown from the condenser blower, but a drain path to this drain pan is heretofore constituted of a hose which lowers from a lower surface of the main body to lead to the drain pan, and this respect also causes the increase of the number of the components.

SUMMARY OF THE INVENTION

The present invention has been developed to solve such a conventional technical problem, and an object thereof is to provide a cooling device capable of simplifying attachment of a blower for a condenser and a structure of a drain path from an evaporator.

A cooling device according to the present invention of a first aspect is characterized by comprising a condenser constituting a part of a refrigerant circuit, and a condenser blower which air-cools this condenser, the cooling device further includes a fan casing attached to the condenser and provided with the condenser blower, and this fan casing is integrally provided with a bracket part with which a motor of the condenser blower is to be attached.

The cooling device according to the present invention of a second aspect is characterized in that the cooling device of the above invention further includes an evaporator which constitutes a part of the refrigerant circuit, and a drain pan which is detachably disposed under the condenser and the fan casing and in which drain water from the evaporator is stored, a part of a drain path of the drain water which leads from the evaporator to the drain pan is formed integrally in the fan casing, and the drain water flows down along a wall surface of the fan casing on the side of the condenser.

The cooling device according to the present invention of a third aspect is characterized in that in the above invention, a receiving portion which receives the drain water from the evaporator is formed integrally with the fan casing, and this receiving portion constitutes a U-trap in the drain path.

The cooling device according to the present invention of a fourth aspect is characterized in that in the above invention of the second or third aspect, the fan casing is formed integrally with a closing plate part which closes a lower surface of the condenser above the drain pan.

The cooling device according to the present invention of a fifth aspect is characterized in that in the above invention, the fan casing is molded of a hard synthetic resin, a base portion of the closing plate part is formed to be thin, and the fan casing is provided rotatably around the base portion.

According to the present invention of the first aspect, the cooling device includes the condenser constituting a part of the refrigerant circuit, and the condenser blower which air-cools this condenser, the cooling device further includes the fan casing attached to the condenser and provided with the condenser blower, and this fan casing is integrally provided with the bracket part with which the motor of the condenser blower is to be attached. Therefore, special brackets for attaching the motor to the fan casing become unnecessary, whereby owing to the reduction of the number of components for providing the condenser blower, the structure can be simplified, costs can be reduced and an assembly operation property can be improved.

Moreover, according to the present invention of the second aspect, in addition to the above invention, the cooling device further includes the evaporator which constitutes a part of the refrigerant circuit, and the drain pan which is detachably disposed under the condenser and the fan casing and in which the drain water from the evaporator is stored, and a part of the drain path of the drain water which leads from the evaporator to the drain pan is formed integrally in the fan casing. Therefore, it is not necessary to separately dispose a hose for allowing the drain water from the evaporator to flow into the drain pan, whereby owing to the reduction of the number of the components, the structure can be simplified, the costs can be reduced and the assembly operation property can be improved.

In particular, it is constituted that the drain water flows down along the wall surface of the fan casing on the side of the condenser, so that the drain water which flows downward is exposed to the air passed through the condenser and having a raised temperature, whereby evaporation of the drain water before flowing into the drain pan can be promoted.

Furthermore, according to the present invention of the third aspect, in addition to the above invention, the receiving portion which receives the drain water from the evaporator is formed integrally with the fan casing, and this receiving portion constitutes the U-trap in the drain path. Therefore, it is not necessary to separately dispose a component for constituting the U-trap of the drain path. Even in this case, owing to the reduction of the number of the components, the structure can be simplified, the costs can be reduced and the assembly operation property can be improved.

Moreover, according to the present invention of the fourth aspect, in addition to the invention of the second or third aspect, the fan casing is provided integrally with the closing plate part which closes the lower surface of the condenser above the drain pan. Therefore, it is not necessary to separately dispose a closing plate for preventing a disadvantage that air leaks from the lower surface of the condenser, whereby owing to the reduction of the number of the components, the structure can be simplified, the costs can be reduced and the assembly operation property can be improved. In particular, when the drain pan is drawn outward, the lower surface of the condenser is exposed, but owing to the presence of this closing plate part, a danger that user's fingers touch the lower surface of the condenser and get injured is advantageously eliminated.

Furthermore, according to the present invention of the fifth aspect, in addition to the above invention, the fan casing is molded of the hard synthetic resin, the base portion of the closing plate part is formed to be thin, and the fan casing is provided rotatably around the base portion. Therefore, when the fan casing is attached to or detached from the condenser, an angle of the closing plate part can be changed, and assembly and maintenance operations are facilitated. The angle of the closing plate part can freely be set, so that a shape of a mold during the molding of the resin can be simplified.

DETAILED DESCRIPTION OF THE PREFERRED EMBODIMENT

Figure 1:
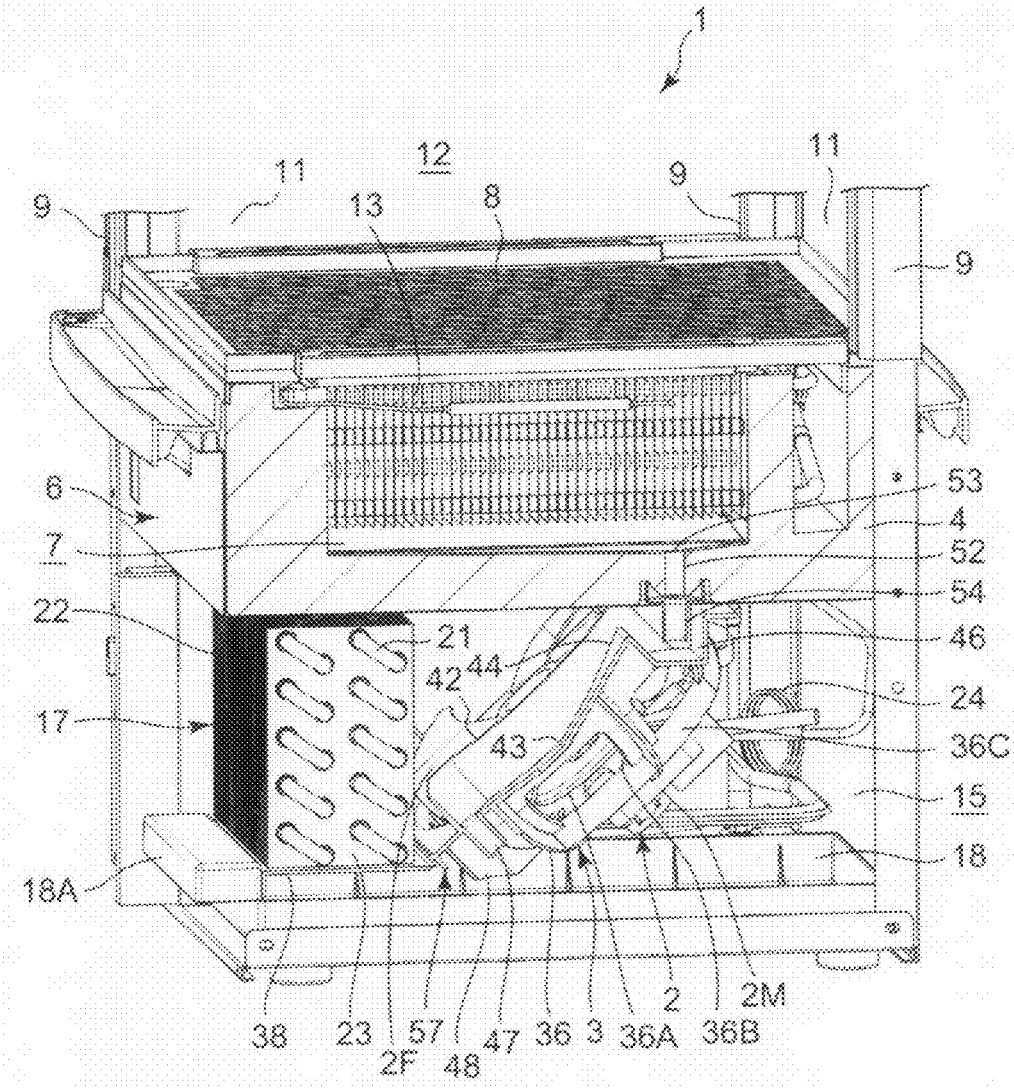
FIG. 1 is a see-through perspective view of a lower part of a low temperature showcase according to one embodiment of a cooling device to which the present invention is applied.
Figure 2:
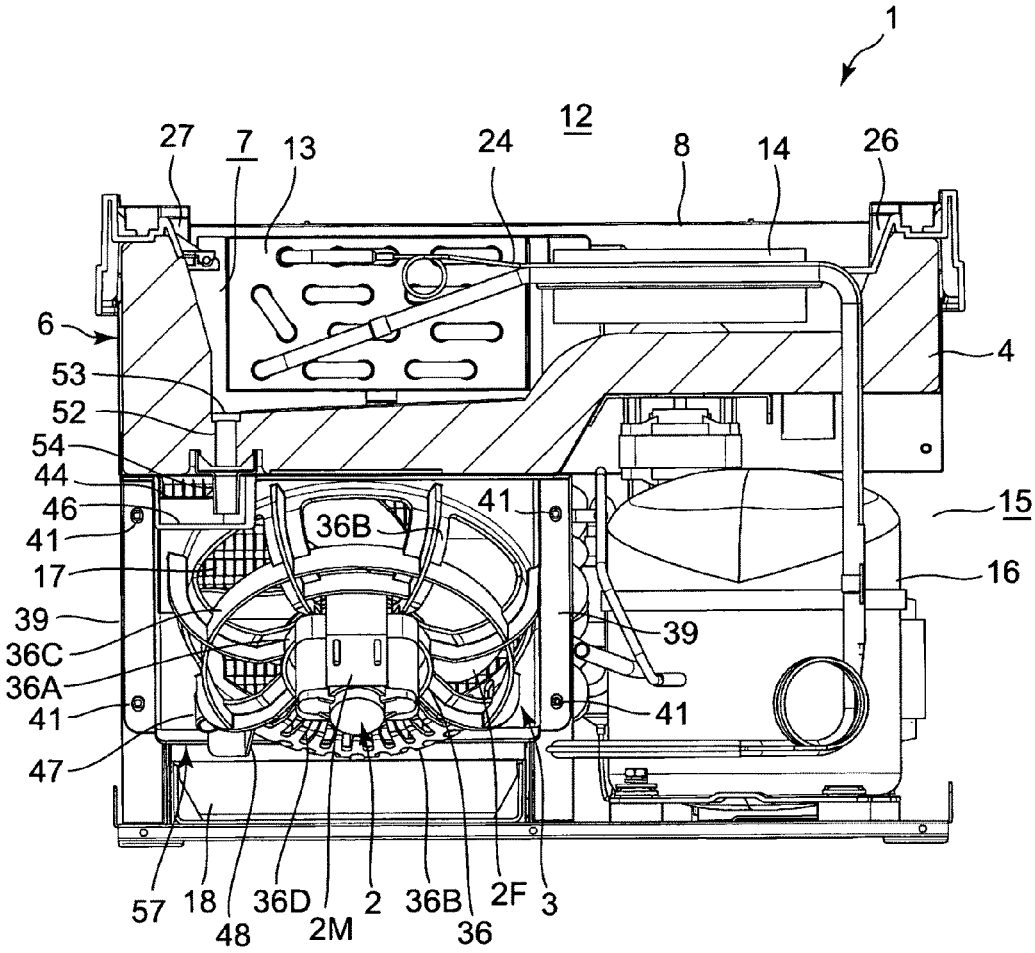
FIG. 2 is a see-through rear view of the lower part of the low temperature showcase of FIG. 1.

An embodiment of the present invention will hereinafter be described with reference to the drawings.

In the drawings, a low temperature showcase 1 of the embodiment is a low temperature showcase of a four-surface glass type and a so-called table top type, and includes a main body (a showcase main body) 6 provided with a rectangular container-like insulation wall 4 which opens in an upper surface thereof, a cooling chamber 7 constituted in the insulation wall 4 of this main body 6, a bottom plate 8 which closes an upper surface of this cooling chamber 7, supports 9 . . . vertically provided at four corners of the main body 6, transparent walls 11 (transparent glass) of opposite side surfaces and a rear surface (sometimes the opposite surfaces only) which are attached between these supports 9 . . . , a transparent door (not shown) of a front surface (sometimes front and rear surfaces), a top plate (not shown) and the like. A space surrounded above the main body 6 with these transparent walls 11, the transparent door, the top plate and the bottom plate 8 is a display chamber 12, and a space under the main body 6 (a lower part of the low temperature showcase 1) is a mechanical chamber 15.

Then, an evaporator 13 constituting a part of a refrigerant circuit and a blower 14 for circulating cold air are installed in the cooling chamber 7. Moreover, in addition to a compressor 16 and a condenser 17 similarly constituting a part of the refrigerant circuit, a condenser blower 2 for blowing outside air through the condenser 17 and the compressor 16 to air-cool them, and a drain pan 18 for evaporating drain water from the evaporator 13 are installed in the mechanical chamber 15.

In this case, the condenser 17 includes a meandering refrigerant pipe 21, a plurality of radiator fins 22 and opposite-side tube plates 23, and is arranged in a front part (one end) of the mechanical chamber 15, and directions of the radiator fins 22 are set so as to circulate the air from a front side (an outer side) to a rear side (the inside of the mechanical chamber 15). The blower 2 for the condenser is constituted of a motor 2M, and a propeller type fan 2F attached to a rotary shaft of this motor 2M, and provided in a fan casing 3 attached to a rear side of the condenser 17 (the inside of the mechanical chamber 15). The drain pan 18 has a rectangular container-like shape and an opened upper surface, is provided under the condenser 17 and the fan casing 3, and detachably inserted in a lower part of the mechanical chamber 15 so that a grasp part 18A formed on a front end (one end) of the pan is held to draw the pan to the front side of the mechanical chamber 15 (an outer side of the condenser 17). In a state in which the drain pan 18 is inserted in the lower part of the mechanical chamber 15, the grasp part 18A of the pan is positioned on a lower front side of a lower edge of the condenser 17.

When the compressor 16, the blower 14 and the blower 2 for the condenser are operated (rotated), a high-temperature refrigerant discharged from the compressor 16 releases heat and is liquefied in the condenser 17, a pressure of the refrigerant is reduced in a capillary tube (a pressure reduction unit) 24 constituting a part of the refrigerant circuit, and then the refrigerant flows into the evaporator 13 to exert a cooling function. The cold air cooled by this evaporator 13 in the cooling chamber 7 is discharged by the blower 14 into the display chamber 12 from a cold air discharge port 26 on one side of the bottom plate 8, and sucked into the cooling chamber 7 from a cold air suction port 27 on the other side. In consequence, commodities are displayed in the display chamber 12 while being cooled to a predetermined temperature.

On the other hand, when the motor 2M of the blower 2 for the condenser is operated to rotate the fan 2F, the outside air is sucked into the condenser 17 and blown therethrough. The refrigerant which has flowed into the condenser 17 is air-cooled with this outside air. The air passed through the condenser 17 to have a raised temperature flows from the rear surface (an inner surface of the mechanical chamber 15), is sucked into the fan 2F from the surface of the condenser blower 2 on a condenser 17 side, obliquely blown down to the rear side (a side opposite to the condenser 17) and blown to the drain pan 18. In consequence, the drain water in the drain pan 18 is evaporated. The air passed through the drain pan 18 flows outward through a periphery of the compressor 16 in the mechanical chamber 15, whereby the compressor 16 is also air-cooled.

Next, a structure of the fan casing 3 will be described in detail. The fan casing 3 of the embodiment is made of a hard synthetic resin, and includes a casing main body 37 integrally molded of a tilted wall 31 tilted substantially at 45 degrees so that the wall is high on a side apart from the condenser 17 and low on the side of the condenser 17 in a state in which the casing is attached to the condenser 17, substantially right-angled triangular side walls 32, 33 which rise from opposite left and right sides (as viewed from the condenser 17) of this tilted wall 31 toward the condenser 17, a circular grille part 34 formed on the tilted wall 31, and a bracket part 36 positioned on an inner side of this grille part 34 and protruded while being curved toward the side opposite to the condenser 17; and a closing plate part 38 provided continuously from a lower edge of the tilted wall 31 of this casing main body 37. A base portion 38A (a connecting portion to the lower edge of the tilted wall 31) of this closing plate part 38 is formed to be thin, whereby the closing plate part 38 is rotatable around the base portion 38A with respect to the casing main body 37.

An outward flange 39 is continuously and integrally molded along an upper edge of the tilted wall 31 and upper and front edges of the side walls 32, 33 of the casing main body 37, and attachment holes 41 are formed in the flange 39 along the front edges of the side walls 32, 33. The bracket part 36 is constituted of a motor fixing portion 36A in the center, a plurality of connecting portions 36B extending radially from this motor fixing portion 36A and provided continuously to an edge of the grille part 34, and a bar portion 36C disposed between these connecting portions 36B. The lower connecting portion 36B is formed to be broad, and provided with a plurality of small holes 36D. Areas between these connecting portions 36B and the lower small holes 36D constitute air blow areas, and the small holes 36D are formed in such a dimension that fingers cannot be inserted.

Here, as described above, the drain pan 18 is present under the condenser 17, so that when the drain pan 18 is drawn outward, a comparatively large space is opened under the condenser 17 and the fan casing 3. Therefore, the fingers might be disposed under the condenser 17 and the condenser blower 2, but the lower connecting portion 36B is formed to be broad and provided with the small holes 36D, whereby a disadvantage that the fingers are inserted in the fan casing 3 and injured with the rotating fan 2F is also prevented.

Figure 3:
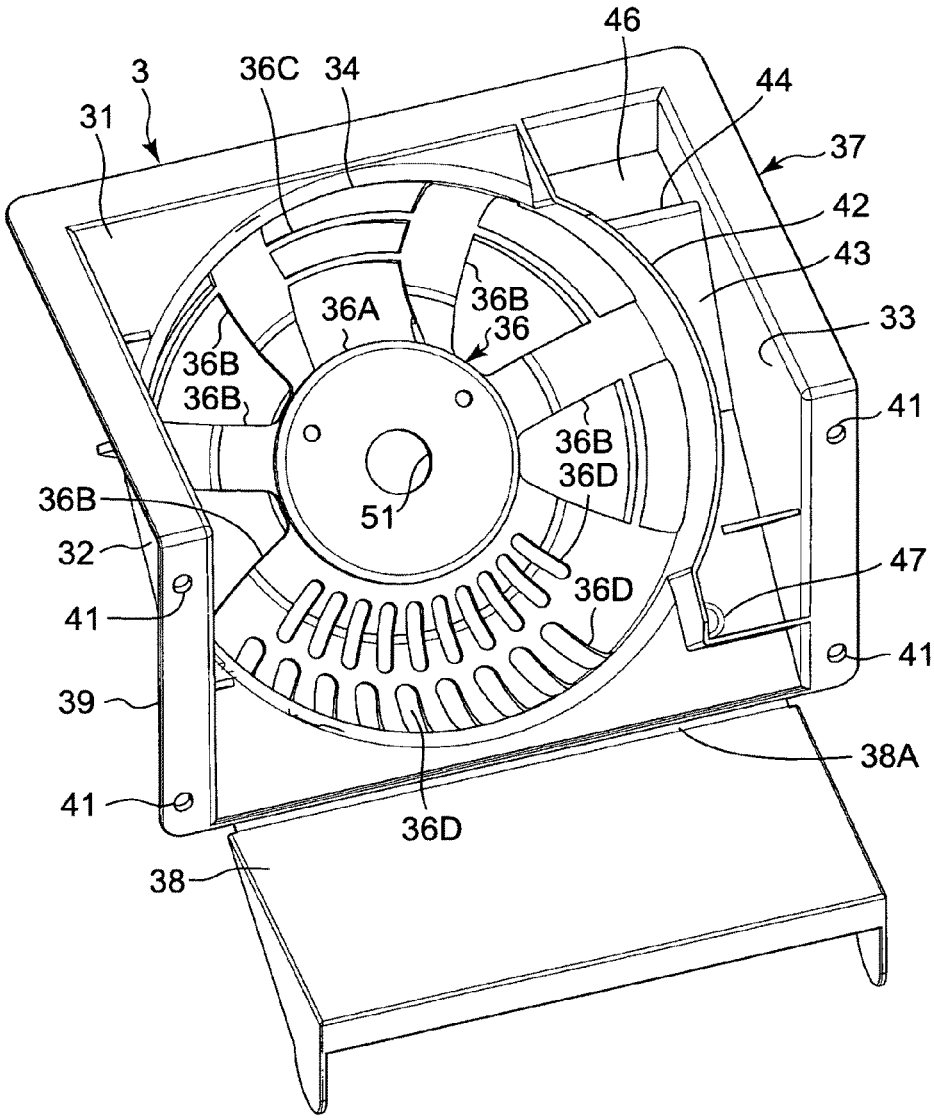
FIG. 3 is a perspective view of a fan casing of the low temperature showcase of FIG. 1.

Moreover, on one side (on the right side viewed from the condenser 17) of the grille part 34, the surface (a front wall surface) of the tilted wall 31 on the condenser 17 side is integrally provided with a partition wall 42 vertically formed over an upper part and a lower part of the tilted wall. In this case, the partition wall 42 lowers so as to hem the grille part 34 from an upper end of the tilted wall 31 at an inner position which is a predetermined dimension apart from the right (one side) wall 33 as viewed from the condenser 17, and a lower end of the partition wall bends rightward (to the one side) and is provided continuously to the side wall 33 (FIG. 3). Then, the condenser 17 side surface (the front wall surface) of the tilted wall 31 between this partition wall 42 and the side wall 33 is provided with a drain path 43.

A protruding bank portion 44 is formed slightly below an upper end of this drain path 43, and the tilted wall 31 above this bank portion 44 is flattened and provided with a receiving portion 46. Moreover, the tilted wall 31 in a lower end of the drain path 43 is provided integrally with a discharge port portion 47 which protrudes to a back side (the drain pan 18 side opposite to the condenser 17 side) of the tilted wall 31. Furthermore, a back wall surface of the tilted wall 31 is provided integrally with a protruding air screen wall 48 positioned on a grille part 34 side of the discharge port portion 47.

Then, the motor 2M of the blower 2 for the condenser is attached to a back surface (the surface of the motor fixing portion opposite to the condenser 17) of the motor fixing portion 36A of the bracket part 36, and fixed to the motor fixing portion 36A. That is, the motor 2M is positioned outside the fan casing 3. Then, the rotary shaft protrudes from a central hole 51 toward the condenser 17, and the fan 2F is attached to a distal end of the rotary shaft. In this state, the fan 2F is positioned in the grille part 34 (the inside of the fan casing 3) on the condenser 17 side of the motor fixing portion 36A. The blower 2 for the condenser is provided on the fan casing 3 in this manner.

Thus, the bracket part 36 is molded integrally with the fan casing 3, so that the number of components can remarkably be reduced, a structure can be simplified, costs can be reduced and an assembly operation property can be improved as compared with a case where the condenser blower is attached to the fan casing by use of special brackets.

On the other hand, a drain hole 52 is formed so as to vertically extend through the insulation wall 4 under the cooling chamber 7, an upper end of the hole opens as a drain port 53 in a bottom surface of the cooling chamber 7, and the bottom surface of the chamber tilts down to this drain port 53. A lower end of the drain hole 52 opens corresponding to a drain socket 54 attached to a lower surface (a ceiling surface of the mechanical chamber 15) of the main body 6, and the drain socket 54 protrudes from a ceiling of the mechanical chamber 15 into the mechanical chamber 15.

Figure 4:
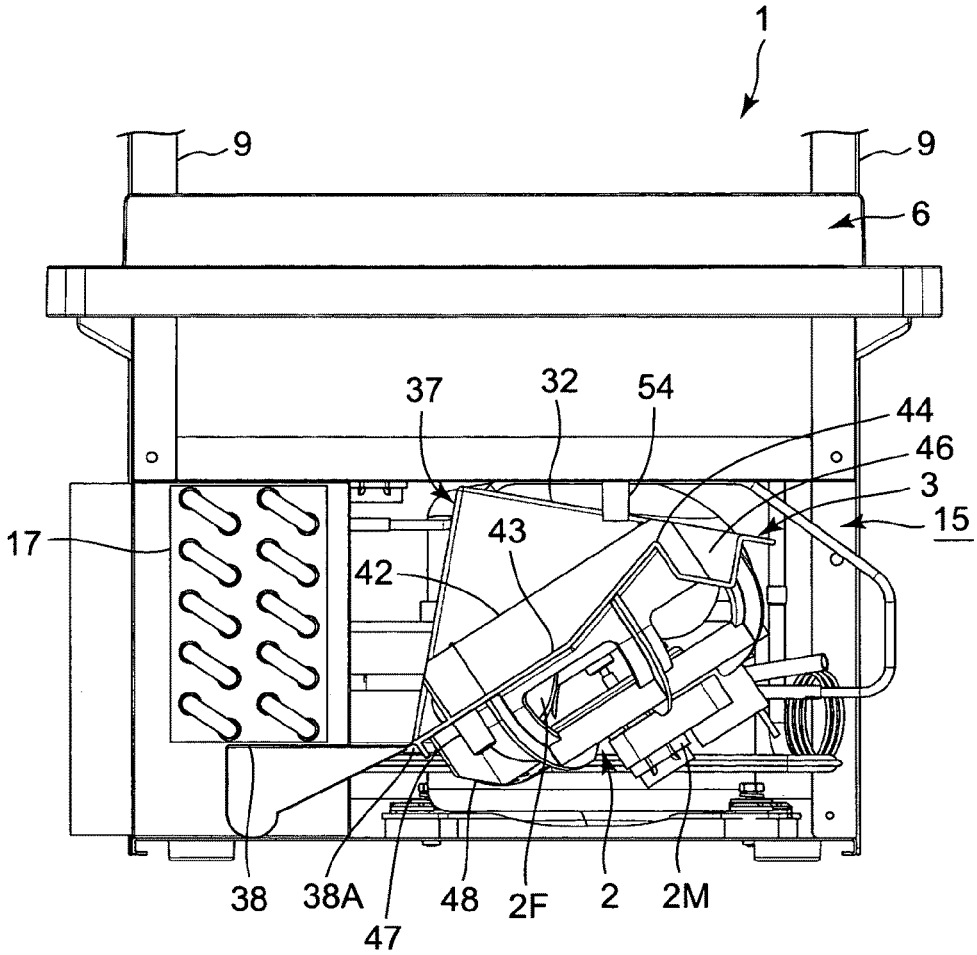
FIG. 4 is a side view of the lower part of the low temperature showcase of FIG. 1, showing an attachment/detachment operation of the fan casing.

Next, an attachment procedure of the fan casing 3 will be described with reference to FIG. 4. It is to be noted that the drain pan 18 is beforehand drawn outward. As described above, the fan casing 3 to which the blower 2 for the condenser has been attached is inserted from the closing plate part 38 thereof into a rear side of the mechanical chamber 15, and the closing plate part 38 is disposed under the condenser 17. In this case, the closing plate part 38 is rotated to beforehand increase an angle formed between the closing plate part and the casing main body 37 (an angle of a front side on which the fan 2F is present), whereby the bank portion 44 can be moved to a front side (the condenser 17 side) of the drain socket 54 so as to avoid the drain socket 54 which protrudes from the ceiling.

Subsequently, when lower ends of the flange 39 on the front ends of the side walls 32, 33 abut on the tube plates 23 of the condenser 17, the casing main body 37 is raised around the base portion 38A (rotated counterclockwise in FIG. 4), thereby allowing the flange 39 to abut on rear surfaces of the tube plates 23. Then, screws are inserted into the attachment holes 41 to fix the flange 39 to the tube plates 23. In this manner, the fan casing 3 and the blower 2 for the condenser are fixed to the rear side (an air outflow side) of the condenser 17.

In this state, the fan 2F is disposed obliquely upward and arranged on the condenser 17 side. Moreover, the flange 39 of an upper part of the fan casing 3 abuts on the ceiling surface of the mechanical chamber 15, and the closing plate part 38 closes a lower surface of the condenser 17. An upper surface of the condenser 17 is closed with the ceiling of the mechanical chamber 15, so that in a case where the blower 2 for the condenser is operated as described above, the air which has flowed into the condenser 17 passes between the fins 22, all flows from the rear surface (the inner surface of the mechanical chamber 15) into the fan casing 3, and is sucked into the fan 2F. That is, the presence of the closing plate part 38 prevents a disadvantage that the air leaks from the fan casing 3 via the lower surface of the condenser 17.

In consequence, it is not necessary to separately dispose a closing plate for preventing a disadvantage that the air leaks from the lower surface of the condenser 17, whereby owing to the reduction of the number of the components, the structure can be simplified, the costs can be reduced and the assembly operation property can be improved. In particular, when the drain pan 18 is drawn outward, the lower surface of the condenser 17 is exposed, but the presence of this closing plate part 38 eliminates a danger that user's fingers touch the lower surface of the condenser 17 (corners of the fins 22, etc.) and get injured.

Moreover, in a state in which the fan casing 3 is attached to the condenser 17 in this manner, the drain socket 54 enters the receiving portion 46 from above. At this time, a lower end of the drain socket 54 is disposed at a position lower than an upper end of the bank portion 44. Furthermore, the discharge port portion 47 opens above the drain pan 18.

The drain water (defrosting water or the like) which has dropped down from the evaporator 13 flows into the drain port 53, flows down through the drain hole 52, and is discharged from the drain socket 54 into the mechanical chamber 15. The drain water which has flowed from the drain socket 54 is once received in the receiving portion 46 of the fan casing 3, then overflows from the bank portion 44 owing to rise of a water level, flows down through the drain path 43 into the discharge port portion 47, and flows through the portion into the drain pan 18.

That is, the receiving portion 46, the drain path 43 and the discharge port portion 47 formed integrally with the fan casing 3 constitute a part of a drain water drain path leading from the evaporator 13 to the drain pan 18. Therefore, it is not necessary to separately dispose a hose for allowing the drain water from the evaporator 13 to flow into the drain pan 18, whereby owing to the reduction of the number of the components, the structure can be simplified, the costs can be reduced, and the assembly operation property can be improved.

In particular, the drain water which has overflowed from the receiving portion 46 flows down along the wall surface of the drain path 43 on the condenser 17 side, so that the drain water which flows downward is exposed to the air passed through the condenser 17 and having a raised temperature, and the evaporation of the drain water before flowing into the drain pan 18 can be promoted. It is to be noted that when, for example, a detour for allowing the drain water to meander is formed in the drain path 43, a time when the drain water flows downward lengthens, and hence the evaporation is further promoted.

Furthermore, the lower end of the drain socket 54 is positioned below the upper end of the bank portion 44. Therefore, a lower opening of the drain socket 54 submerges in the drain water received in the receiving portion 46. That is, this receiving portion 46 constitutes a U-trap in the drain path. In consequence, it is not necessary to separately dispose a component for constituting the U-trap of the drain path leading from the evaporator 13 to the drain pan 18, whereby owing to the reduction of the number of the components, the structure can be simplified, the costs can be reduced, and the assembly operation property can be improved.

Moreover, the discharge port portion 47 on the grille part 34 side is provided integrally with the protruding air screen wall 48, thereby preventing a disadvantage that the drain water which has flowed from the discharge port portion 47 is stirred by the air blown from the fan 2F and scatters outside the drain pan 18. It is to be noted that when the fan casing 3 is drawn from the mechanical chamber 15, an operation reverse to the above-mentioned operation is performed. That is, first the fan casing 3 is detached from the tube plates 23 of the condenser 17, the casing main body 37 is rotated (clockwise in FIG. 4) around the base portion 38A as shown in FIG. 4, and the bank portion 44 is lowered below the drain socket 54. In consequence, the fan casing 3 can be drawn rearward from the mechanical chamber 15.

Thus, the base portion 38A of the closing plate part 38 is formed to be thin so that the casing main body can be rotated around the base portion 38A. Therefore, when the fan casing 3 is attached to or detached from the condenser 17, an angle of the closing plate part 38 can be changed, and assembly and maintenance operations are facilitated.

Figure 5:
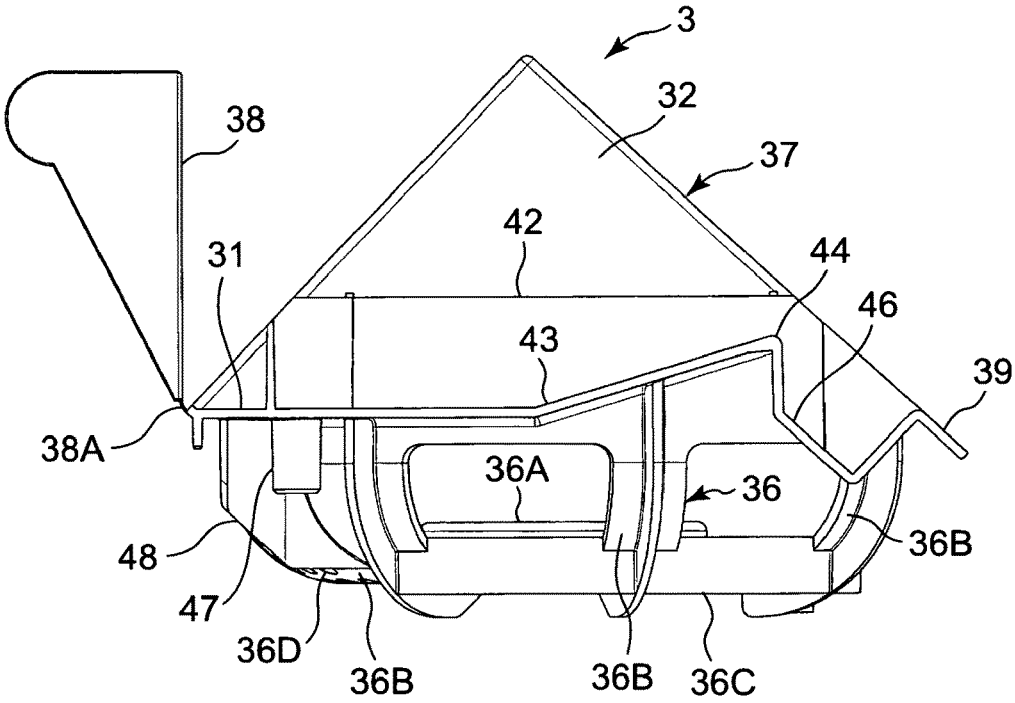
FIG. 5 is a diagram showing a shape of the fan casing of FIG. 3 during molding of a resin.

Moreover, the angle of the closing plate part 38 can freely be set, and hence, for example, as shown in FIG. 5, the closing plate part can be molded of a resin so that an angle formed by the closing plate part 38 and the tilted wall 31 is a right angle (at this time, the wall of the bank portion 44 on the receiving portion 46 side is also parallel to the closing plate part 38 as shown in FIG. 5). The fan casing 3 can be molded into a shape shown in FIG. 5 with a surface-side (an upper surface in FIG. 5) mold of the fan casing and a back-surface-side (a lower surface in FIG. 5) mold thereof, and shapes of the molds can remarkably be simplified.

It is to be noted that in the embodiment, the present invention has been described in accordance with an example of the low-temperature showcase, but the present invention is not limited to the embodiment, and the present invention is effective to the general cooling device including the fan casing provided with the condenser blower.

What is claimed is:

1. A cooling device comprising a condenser constituting a part of a refrigerant circuit; and a condenser blower which air-cools the condenser, the cooling device further including a fan casing attached to the condenser and provided with the condenser blower, wherein the fan casing is integrally provided with a bracket part by which a motor of the condenser blower is attached, further comprising an evaporator which constitutes a part of the refrigerant circuit; and a drain pan which is detachably disposed under the condenser and the fan casing and in which drain water from the evaporator is stored, wherein a part of a drain path of the drain water which leads from the evaporator to the drain pan is formed integrally in the fan casing so that the drain water flows down along a wall surface of the fan casing on the side of the condenser outside of the bracket part.

2. The cooling device according to claim 1, wherein a receiving portion which receives the drain water from the evaporator is formed integrally with the fan casing, and the receiving portion constitutes a U-trap in the drain path.

3. The cooling device according to claim 1 or 2, wherein the fan casing is formed integrally with a closing plate part which closes a lower surface of the condenser above the drain pan.

4. The cooling device according to claim 3, wherein the fan casing is molded of a hard synthetic resin, a base portion of the closing plate part is formed to be thin, and the fan casing is provided rotatably around the base portion.

* * * * *